United States Patent [19]

Ledoux

[11] Patent Number: 4,635,588

[45] Date of Patent: Jan. 13, 1987

[54] HEATERS FOR THERMAL ENERGY TRANSFORMATION INSTALLATIONS

[75] Inventor: Jules F. R. Ledoux, Nivelles, Belgium

[73] Assignee: Hamon-Sobelco S.A., Brussels, Belgium

[21] Appl. No.: 798,631

[22] Filed: Nov. 15, 1985

[30] Foreign Application Priority Data

Feb. 25, 1985 [EP] European Pat. Off. ..... 85870030.5

[51] Int. Cl.[4] ..... F22B 33/00

[52] U.S. Cl. ..... 122/1 C; 122/262; 122/355; 122/444; 122/451 S; 122/483; 165/113; 165/145

[58] Field of Search ..... 122/1 C, 197, 202, 262, 122/275, 312, 331, 355, 412, 414, 428, 442, 444, 451 R, 451 S, 452, 459, 460, 483, 487; 165/113, 145

[56] References Cited

U.S. PATENT DOCUMENTS

| | | | |
|---|---|---|---|
| 1,936,284 | 11/1933 | Bergman | 122/355 |
| 2,640,687 | 6/1953 | Throckmorton | 122/355 X |
| 2,643,519 | 6/1953 | Powell | 122/1 C |
| 2,921,441 | 1/1960 | Buri | 122/1 C |
| 3,032,999 | 5/1962 | Pacault | 122/1 C |
| 4,073,267 | 2/1978 | Hunt et al. | 122/483 X |

FOREIGN PATENT DOCUMENTS

| | | |
|---|---|---|
| 32641 | 7/1981 | European Pat. Off. . |
| 1119874 | 12/1961 | Fed. Rep. of Germany . |
| 157699 | 7/1970 | Fed. Rep. of Germany . |
| 1948914 | 4/1971 | Fed. Rep. of Germany . |
| 1912341 | 6/1979 | Fed. Rep. of Germany . |
| 3301338 | 7/1984 | Fed. Rep. of Germany . |
| 1054671 | 2/1954 | France . |
| 1153029 | 2/1958 | France . |
| 1248874 | 11/1960 | France . |
| 1509175 | 1/1968 | France . |
| 1523810 | 3/1968 | France . |
| 2060383 | 9/1970 | France . |
| 1173896 | 12/1969 | United Kingdom . |

*Primary Examiner*—Albert J. Makay
*Assistant Examiner*—Steven E. Warner
*Attorney, Agent, or Firm*—Walter H. Schneider

[57] ABSTRACT

A heater comprising two separate tube nests of which one (29) heats the circulating water by condensation and supercooling and the other (39) heats a partial flow of this water by the desuperheating of steam. Steam is admitted through pipe (16). The foregoing partial flow of water comes from the desuperheating zone of a heater located downstream and is admitted through a manifold (41). Pipes (39) are wound round a central drum (43).

6 Claims, 9 Drawing Figures

FIG. 5
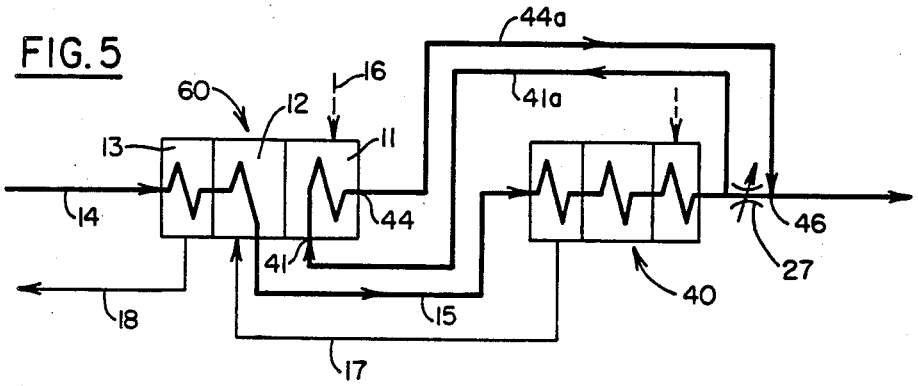
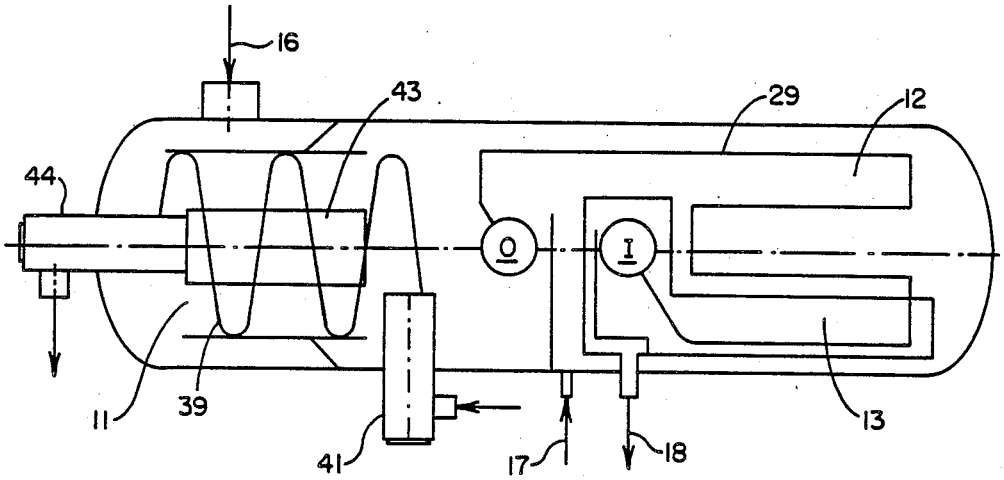
FIG. 6

HEATERS FOR THERMAL ENERGY TRANSFORMATION INSTALLATIONS

BACKGROUND OF THE INVENTION

1. Field of the Invention

This invention concerns heaters for installations to transform thermal into mechanical energy.

Such installations use at least one condensable fluid making a thermodynamic cycle comprising vapor generating means, vapor heating means, vapor condensing means and vapor using means. In particular these are fossil or nuclear power stations.

By condensable fluid is generally understood water or possibly ammonia or even any fluid whatsoever presenting itself in the vapor and liquid phases during the various values of the pressure/temperature characteristics of the thermodynamic cycle.

More particularly, the invention refers to heaters with two separate nests, one of which heats the circulating water by condensation and supercooling and the other heats a partial flow of this water by desuperheating of the steam.

2. Description of the Prior Art

In FIG. 1 of the drawing, which represents the prior art, there is shown a diagrammatic representation of two heaters 10, 20 of a conventional cycle for transformation of thermal into mechanical energy. Each heater is compartmentalized into three zones: the desuperheating zone 11, condensation zone 12 and supercooling zone 13. The water to be heated, which is the feedwater of the cycle, enters by pipe 14 into the supercooling zone 13 and subsequently passes into condensation zone 12, before crossing the desuperheating zone 11 and leaving by a pipe 15 which can be connected to the inlet of the next heater 20.

Steam enters through 16 in the desuperheating zone 11 of each heater and next passes into condensation zone 12 where all the steam is transformed into condensate. The condensate from heater 10 is mixed with the condensate extracted by pipe 17 from the supercooling zone 13 of adjacent heater 20 and is subsequently sent to its own supercooling zone 13 before being extracted in its turn by pipe 18 to an adjacent heater located upstream.

FIG. 2 is a more detailed section view of the conventional heater 10 or 20 showing at I the inlet manifold of the water to be heated and at O the outlet manifold of the water. Between these two manifolds the water passes in an assembly of heat exchanger tubes 19 generally forming a nest of tubes bent into a single or triple U (termed W) and laii out in several layers. A first section of this nest of tubes 19 is connected to the inlet manifold I and is located in a box 21 which demarcates the supercooling zone 13 filled with condensate 22 and which is fitted with a condensate outlet 18. A second section of tubes 19' is located in condensation zone 12 filled with steam from box 23 which demarcates desuperheating zone 11, in which is located the water outlet manifold O connected to the third section of tubes 19''. To this box 23 is connected the steam inlet pipe 16. Heater assemblies 10 and 20 are generally mounted in a cylindrical vessel 24 closed at the ends by dished ends 25.

Complete installations of conventional heating are in particular described and shown (FIGS. 1 and 3) in patent EP No. 0032641.

So as to improve this conventional cycle, represented by FIG. 1 of the drawing, from the thermodynamic standpoint and to obtain a better efficiency of the thermal conversion, cycles or circuits as shown in FIGS. 3 and 4 of the drawing have already been proposed. In the embodiment of FIG. 3, heater 50 forming the desuperheating zone 11 is separate from heater 30 and recovers the heat of the steam which it desuperheats at a higher temperature level. Generally, it only treats a part of the total flow of the water to be heated, at least 30%, but more usually about 50%.

The embodiment of FIG. 3 has already been applied to power stations. Heaters 30, 40 and 50 are of conventional design, consisting of curved tubes connected to either a water box through a tube plate, or to two manifolds, one being the inlet one and the other the outlet one, as shown in FIG. 2. In contrast, heater 30 comprises only supercooling zone 13 and condensation zone 12. This condensation zone 12 receives some steam from heater 50 through 26, as well as the condensate from the supercooling zone of the adjacent heater 40 through 17. Heater 50 receives some steam extracted at 16 and heats in its desuperheating zone 11 part of the feedwater flow leaving heater 40. Bypass pipe XY of heater 50 is provided with a throttle 27 ensuring that the exchanger 50 receives the water flow for which it has been designed. In installations where all the feedwater flow goes through 50, 27 is a normally closed valve.

The embodiment of FIG. 4 has already been described in French patent No. 1,153,029. In this embodiment, the partial flow of the water to be heated comes from condensation zone 12 of heater 30 and is reinjected in the water pipe downstream of heater 40 or at outlet of desuperheating zone 11 of this heater 40. The partial flow can vary in this execution from 3 to 25% of the total flow of the water to be heated.

The investment cost of these two embodiments of FIGS. 3 and 4 is markedly greater than that for the embodiment of FIG. 1. Not only are the exchange surfaces greater than those of heater 10, but also vessels 24, dished ends 25 and the infrastructure are much more costly for whole of heaters 30 and 50 than for heater 10. Heaters 30 and 50 also require more space in the machine room and more connecting piping. On the other hand, the dimensions of heater 50 with tubes curved as U or W are such that it is not economically conceivable to integrate heater 50 in heater 30.

The embodiment of FIG. 4 has apparently never been applied practically because the heat data concerning heater 50' dictate very large heater dimensions including great tube lengths and, therefore, would require an excessively high investment cost, not offset by the reduction of energy consumption costs. Integration of heater 50' in heater 30 is even less conceivable in the embodiment of FIG. 4 than it is for FIG. 3.

SUMMARY OF THE INVENTION

The invention aims to carry out the heating in installations of the type referred to with the maximum possible effectiveness and the minimum space requirement.

Referring to the prior art description of FIGS. 1–4, made hereinabove, the object of this invention is more particularly to re-integrate exchanger or heater 50 or 50' in heater 30, while maintaining the layouts and the thermodynamic characteristics comparable to schemes of FIGS. 3 and 4.

These objectives are attained by the invention as defined in the claims made at the end of this description.

DESCRIPTION OF THE DRAWINGS

In the drawings which illustrate that which is presently considered as the best mode for carrying out the invention, FIGS. 5 and 8 show diagrammatically parts of the heating installations in accordance with the invention and FIGS. 6, 7 and 9 show diagrammatically the longitudinal section of a heater according to the invention in two forms, one shown in FIGS. 6 and 7 and the other in FIG. 9.

DESCRIPTION OF THE PREFERRED EMBODIMENTS

Figure 7:
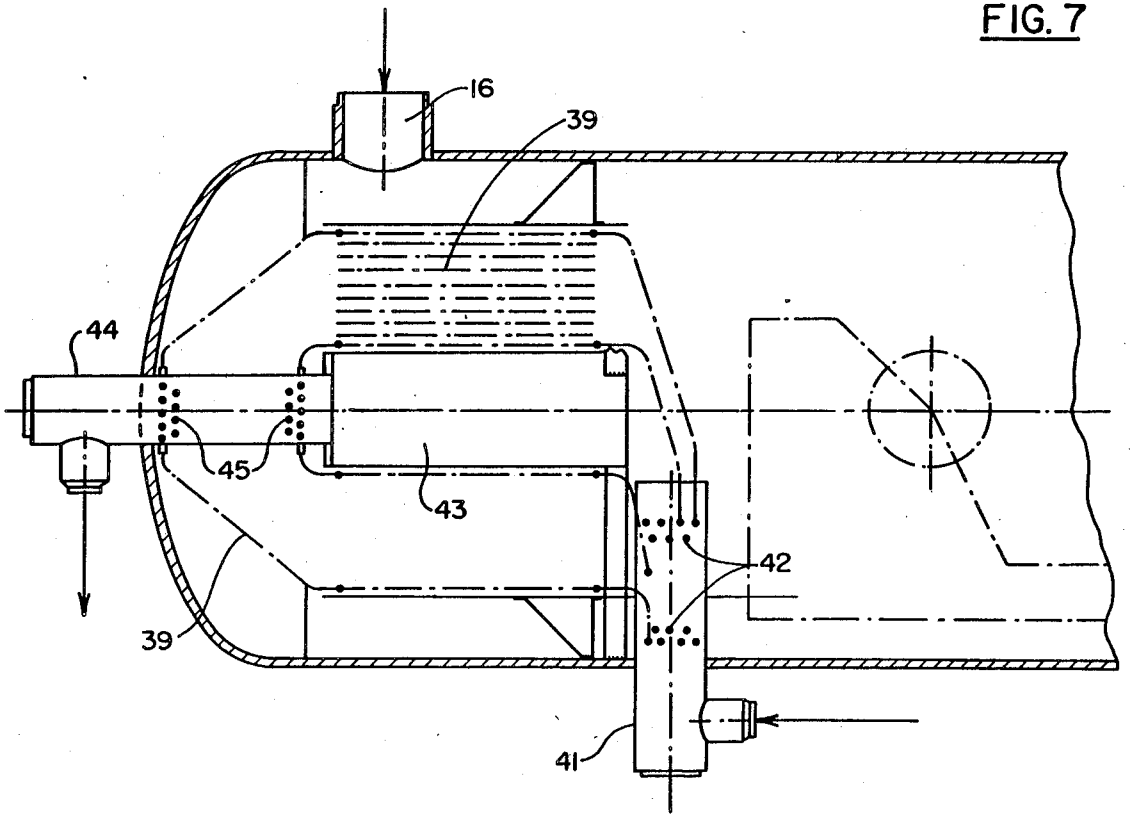

A first heat exchange cycle in accordance with the invention is shown in FIGS. 5 to 7. This cycle corresponds to the embodiment shown in FIG. 3.

As shown in FIG. 5, the cycle comprises a modified heater 60 connected to a conventional heater 40. Feed water is introduced at 14 of heater 60 in conventional fashion, passed through supercooling zone 13, then extracted from condensation zone 12 and passed as by conduit 15 to be injected into the supercooling zone 13 of conventional heater 40. A partial flow of heated feed water taken from the downstream side of heater 40 is recycled as at 41*a* to modified heater 60 and introduced through manifold 41 into its desuperheating zone 11 into which steam is introduced through means 16.

Figure 1:
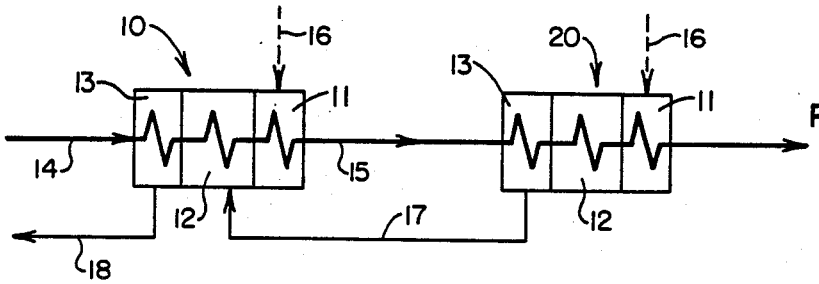
FIG. 1 PRIOR ART
FIGS. 1, 3 and 4 show diagrammatically parts of the known heating installations.
Figure 2:
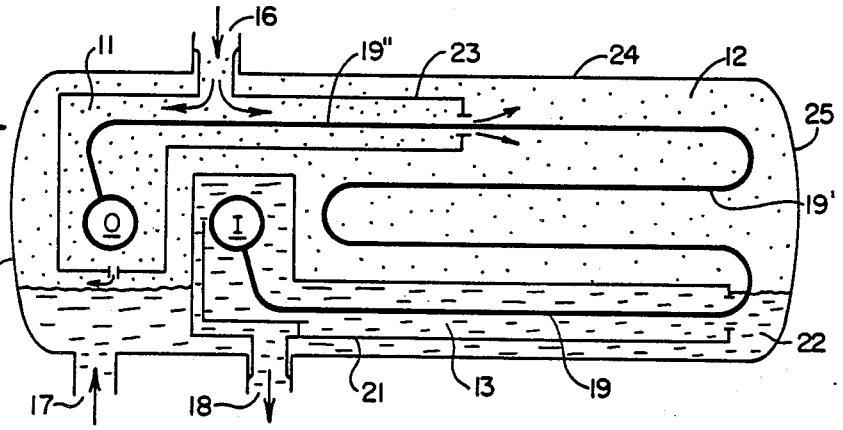
FIG. 2 PRIOR ART
FIG. 2 shows diagrammatically the longitudinal section of a conventional heater.

Modified heater 60 is made up of two separate nests of tubes as shown in FIG. 6. The first nest 29 comprising the tubes of supercooling zone 13 and condensation zone 12 is similar to that as in conventional heater 10 of FIG. 2 and comprises tubes curved as a U or a W. The second nest, however, i.e., the nest 39 in desuperheating zone 11, comprises tubes that are spirally wound as shown in FIG. 6. The connecting points for the tubes of nest 39 are indicated diagrammatically at 42 in FIG. 7, the tubes being wound around a central drum 43. The partial stream of feed water thus heated in the spirally wound nest of tubes 39 passes to an outlet manifold 44, the connections to which are diagrammatically shown in FIG. 7 at 45. The heated partial stream of feed water is conveyed by 44*a* of FIG. 6 to a point downstream of its original extraction at heater 40 and reintroduced into the feed water line as at 46.

The technique of spirally winding tubes 39 around the drum or central core 43 and the installation of the whole in the vessel by means of a tube plate and spacers is borrowed from heat exchangers with spirally wound nests used in the chemical industry and in nuclear reactors.

This technique is in particular described in French patent No. 1,248,874 and German patent DE-AS No. 19 12 341.

Figure 3:
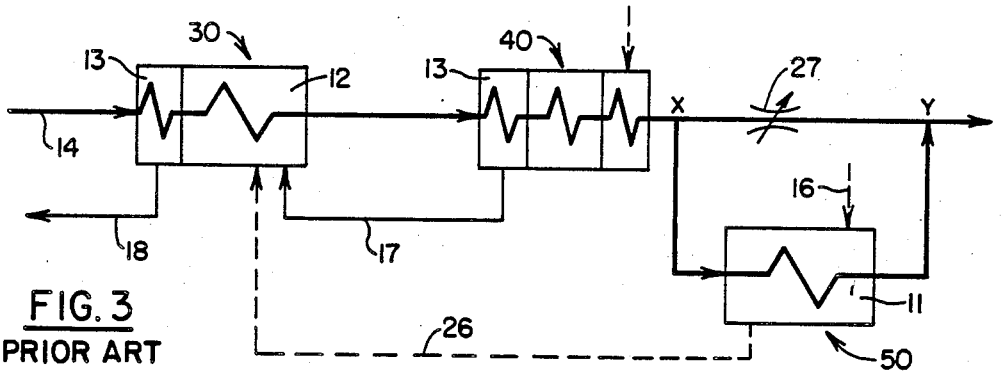
FIG. 3 PRIOR ART
Figure 4:
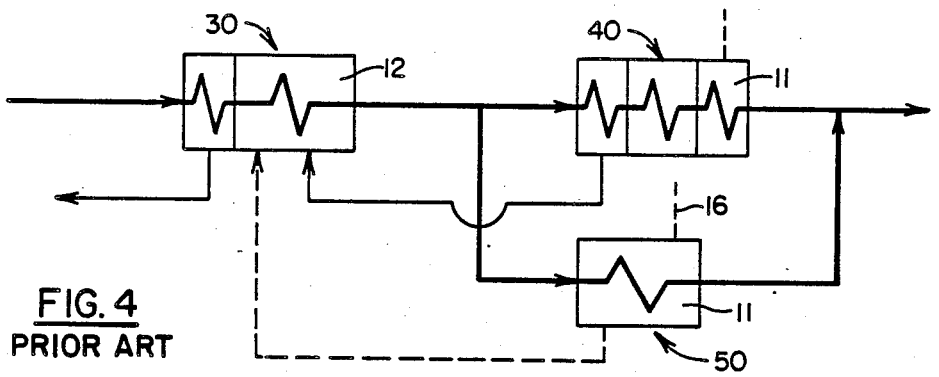
FIG. 4 PRIOR ART

The spirally winding round a drum allows the placing of very long tubes in a relatively small space and in this case, the reintegration into the heater of the desuperheater which was separate in embodiment of FIGS. 3 and 4. The tubes are spirally wound in superimposed layers in alternately clockwise and counter-clockwise directions to avoid the gas from being brought up to turbulent flow speed.

Figure 8:
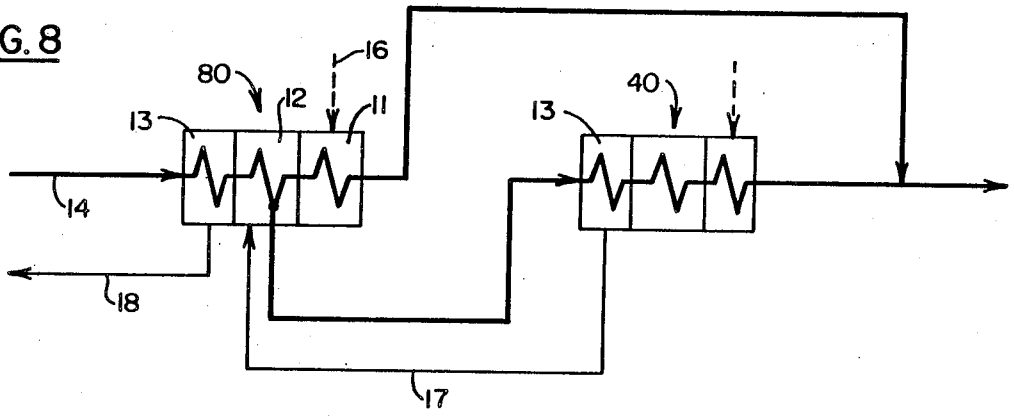
Figure 9:
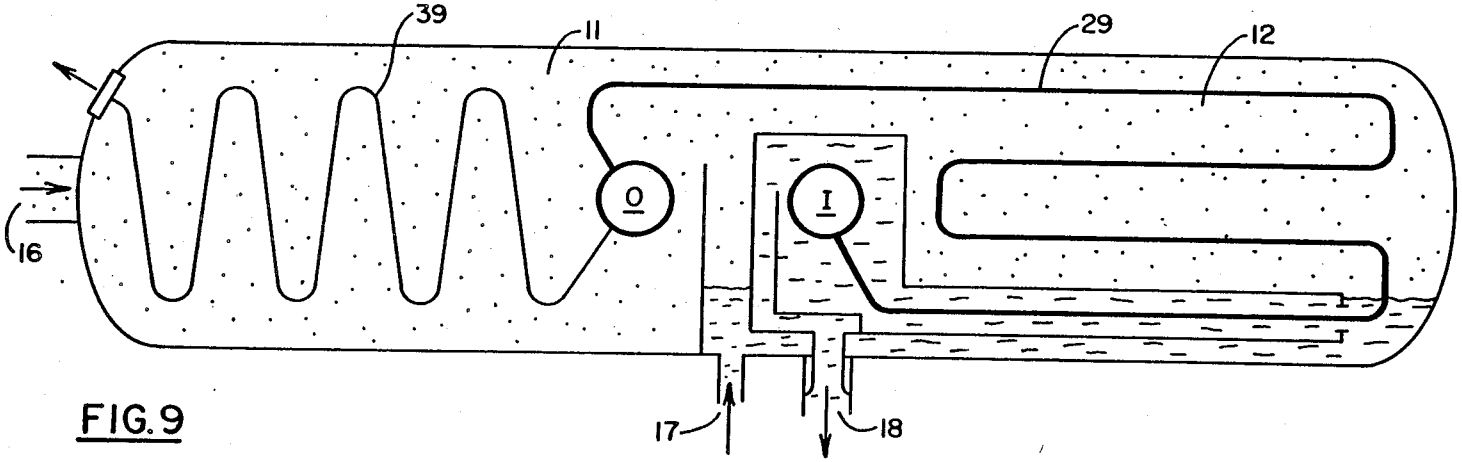

A second cycle of heat exchange in accordance with the invention is shown in FIGS. 8 and 9. This cycle corresponds to the embodiment shown in FIG. 4. It comprises a heater 80, also made by means of two separate tube nests, that is to say a first tube cluster 29 of the conventional curved type, as U or as W, and a second tube nest 39 of the above described spirally wound type in connection with FIGS. 5 to 7. As in FIG. 4, the unmodified heater 40 receives in its supercooling zone 13 a part of the water which comes from the condensation zone 12 of the modified preceding heater 80. The other part of this water passes in the desuperheating zone 11 which here is integrated with heater 80 (while it is separate from heater 30 in FIG. 4). As in FIG. 4, the water which leaves this desuperheating zone 11 rejoins that which leaves the unmodified heater 40, downstream of it.

The heaters in accordance with the invention, as illustrated in FIGS. 5 to 9, offer the following benefits:

two independent nests: hence the possibility of adapting the choice of materials, thickness, diameters of tubes to service conditions;

independence of nests: hence flexibility in case of repair or replacement. Only one part of the exchange surface is affected, either the desuperheating zone, or the one of condensation and of supercooling, when a nest is out of service;

compactness of scheme: saving of space in the machine room; saving of connecting piping between equipments; saving of equipment supports and piping; saving of vessel and of dished ends.

Even though the foregoing description is illustrated by manifold heaters, the invention also covers tube plate heaters.

The invention is not limited to the details described above, but may undergo many modifications which remain included therein.

I claim:

1. In an installation for the transformation of thermal energy into mechanical energy by causing a condensable fluid to effect a thermodynamic cycle through vapor generating means, vapor heating means, vapor condensing means, and vapor using means, said vapor heating means comprising a first heat exchanger within which are incorporated separate desuperheating, condensation and supercooling zones, each of said zones comprising at least one tube having a wall through which heat is exchanged between a condensable fluid flowing within said tube and a second condensable fluid flowing outside said tube, the improvement which comprises a separate first nest of heat exchange tubes formed in the shape of a triple U in said condensation and supercooling zones within said first heat exchanger and a separate second nest of spirally wound heat exchange tubes in said desuperheating zone within said first heat exchanger, each nest of heat exchange tubes having inlet and outlet ends.

2. The improvement according to claim 1, wherein said desuperheating zone comprises a drum extending along the longitudinal axis thereof around which said heat exchange tubes are spirally wound in superimposed layers in alternating clockwise and counter-clockwise directions.

3. The improvement according to claim 1 in which said first heat exchanger is connected to at least one additional downstream heat exchanger comprising desuperheating, condensation and supercooling zones having a single nest of heat exchange tubes formed in the shape of a triple U and having inlet and discharge ends, the inlet end of said second or spirally wound tube nest of said first heat exchanger being connected to the discharge end of said single tube nest of said downstream heat exchanger and the outlet end thereof being connected downstream of said discharge end whereby a partial flow from said discharge end of said single tube nest of said downstream heat exchanger is circulated through said spirally wound tube nest of said first heat exchanger, the outlet end of said first tube nest of said first heat exchanger being connected to the inlet end of said single tube nest of said downstream heat exchanger for conveying the balance of the flow from said first tube nest.

4. The improvement according to claim 1 in which said first heat exchanger is connected to at least one additional downstream heat exchanger comprising desuperheating, condensation and supercooling zones having a single nest of heat exchange tubes formed in the shape of a triple U and having inlet and discharge ends, the inlet end of said second or spirally wound tube nest of said first heat exchanger being connected to the outlet end of said first tube nest of said first heat exchanger and the outlet end thereof being connected to the discharge end of said single tube nest of said downstream heat exchanger whereby a partial flow from said first tube nest is circulated through said spirally wound tube nest, the outlet end of said first tube nest being further connected to the inlet end of said single tube nest of said downstream heat exchanger for conveying the balance of the flow from said first tube nest.

5. The improvement according to claim 3 in which means are provided for conveying the condensate from the supercooling zone of said downstream heat exchanger for injection into the condensation zone of said first heat exchanger.

6. The improvement according to claim 4 in which means are provided for conveying the condensate from the supercooling zone of said downstream heat exchanger for injection into the condensation zone of said first heat exchanger.

* * * * *